US008047448B1

(12) United States Patent
Miller et al.

(10) Patent No.: US 8,047,448 B1
(45) Date of Patent: Nov. 1, 2011

(54) MODULAR AIR CONDITIONING SYSTEM

(75) Inventors: Matthew Miller, Linden, MI (US); Zeke Carlyon, Vassar, MI (US)

(73) Assignee: Mitek Holdings, Inc., Wilmington, DE (US)

( * ) Notice: Subject to any disclaimer, the term of this patent is extended or adjusted under 35 U.S.C. 154(b) by 698 days.

(21) Appl. No.: 11/983,847

(22) Filed: Nov. 13, 2007

(51) Int. Cl.
*F24F 7/00* (2006.01)

(52) U.S. Cl. ..... 236/49.3; 236/44 C; 62/262; 62/263; 62/298

(58) Field of Classification Search ..... 62/176, 62/262–263, 90–91, 317, 298, 331, 332; 236/49.3, 44 C; 165/217, 251, 22; 219/201; 454/250, 256
See application file for complete search history.

(56) References Cited

U.S. PATENT DOCUMENTS 2,079,562 A * 5/1937 Olson et al. ..... 165/60
3,534,810 A * 10/1970 Limoni ..... 165/47
3,618,659 A * 11/1971 Rawal ..... 165/248
3,831,395 A * 8/1974 Levy ..... 62/263
5,275,333 A * 1/1994 Tamblyn ..... 236/51
5,485,878 A 1/1996 Derks
5,590,830 A * 1/1997 Kettler et al. ..... 236/49.3
5,725,148 A 3/1998 Hartman
6,196,469 B1 * 3/2001 Pearson ..... 236/49.3
6,624,394 B2 9/2003 Chasen et al.
7,174,741 B2 2/2007 Lee et al.
7,258,606 B1 * 8/2007 Reid ..... 454/204

* cited by examiner

*Primary Examiner* — George Nguyen
(74) *Attorney, Agent, or Firm* — Senniger Powers LLP

(57) ABSTRACT

The invention is a modular heating, cooling and humidifying unit designed to fit within, or be interposed between segments of existing air ducting systems. The invention includes a plenum through which air is received from a central system within a structure, and which discharges heated, cooled and/or humidified air to a particular compartment within the structure, such as a room. The invention includes within the plenum a heating coil, a cooling coil and a humidifier, one or more dampeners and one or more air filters. Each of these elements is provided with controls which may be both manually and automatically operated to regulate the temperature and humidity of air being discharged into the desired room or compartment.

16 Claims, 5 Drawing Sheets

MODULAR AIR CONDITIONING SYSTEM

FIELD OF THE INVENTION

The present invention relates to modular air conditioning units, and more particularly, air conditioning units which can be easily integrated into existing duct work servicing individual rooms in a multi-room structure.

BACKGROUND OF THE INVENTION

Modern large commercial buildings, such as factories, hotels, office buildings and hospitals, frequently use large and complex heating, ventilating and air conditioning (HVAC) equipment.

It is known to equip commercial buildings with variable air volume systems, which are capable of meeting the entire cooling and heating requirements of the building. Within the building, there are likely to be located a number of terminal units in different zones throughout the building, each connected via duct work to a central air supply. Such terminal units are sized to meet the conditions of the space which each serves, but, as a result, multiple offices, rooms or compartments within the structure are necessarily supplied with heating and cooling air by one terminal unit.

The end result of this type of design is that individual rooms or compartments within a structure are forced to share a common heating and cooling environment. While this may represent nothing more than a minor inconvenience for many building occupants in most cases, it presents particular difficulties in some specific environments, for example, hospital operating rooms.

Precise control of temperature and humidity in hospital operating rooms is important. Such rooms are frequently equipped with a number of machines which generate substantial heat. Further, the rooms will be populated with a varying number of workers during a typical operative procedure. Further, operating rooms must be regularly reconfigured for different procedures, meaning that the equipment and personnel contained within the room will vary substantially from day to day.

Under these circumstances, it is extremely difficult to maintain desired, consistent temperature and humidity levels in specific areas within buildings where centralized heating, ventilating and air conditioning systems are in use.

While it is known to install modular heating, ventilating and air conditioning systems in individual rooms and compartments, many such devices are inefficient, cumbersome to install, and take up substantial space in the room in which they are installed. Further, such stand alone units are not centrally located within the rooms or compartments which they are designed to service, resulting in an imbalance in temperature and humidity in different areas of the same room or compartment. Further, such self-contained units often recirculate, rather than vent room air. Such units sometimes are in conflict in operation with the building central heating, ventilating and air conditioning system, resulting in energy inefficiencies when a local modular unit attempts to heat the air within a particular room or compartment at the same time as the centralized heating, ventilating and air conditioning system is attempting to cool the very same space.

It is desirable, therefore, to implement a modular heating, cooling and humidifying system which works in concert with the centralized heating, ventilating and air conditioning system of a larger structure, and which can be placed within the air ducting system of an existing structure, allowing individual temperature and humidity control in a single compartment or room, while at the same time not occupying physical space within the room or compartment, and further operating in symbiosis with the central heating, ventilating and air conditioning system of the structure.

SUMMARY OF THE INVENTION

The invention comprises a modular heating, cooling and humidifying unit designed to fit within, or be interposed between segments of the existing overhead, in wall or under floor air ducting system of a multi-room structure. The invention comprises a plenum through which air is received from a central HVAC system in the structure, which discharges heated, cooled and/or humidified air to a particular compartment within the structure, and which may, in some applications, further discharge air into the ducting system of the structure. The invention includes within the plenum a heating coil, a cooling coil and a humidifier, one or more dampers, and one or more air filters. The cooling coil is provided with a liquid refrigerant, the heating coil is provided with a supply of hot water or steam, and the humidifier is supplied with water. Each of the elements is provided with controls which may be both manually and automatically operated, to regulate the temperature and humidity of air being discharged from the plenum into the desired room or compartment.

DESCRIPTION OF ONE EMBODIMENT

Figure 1:
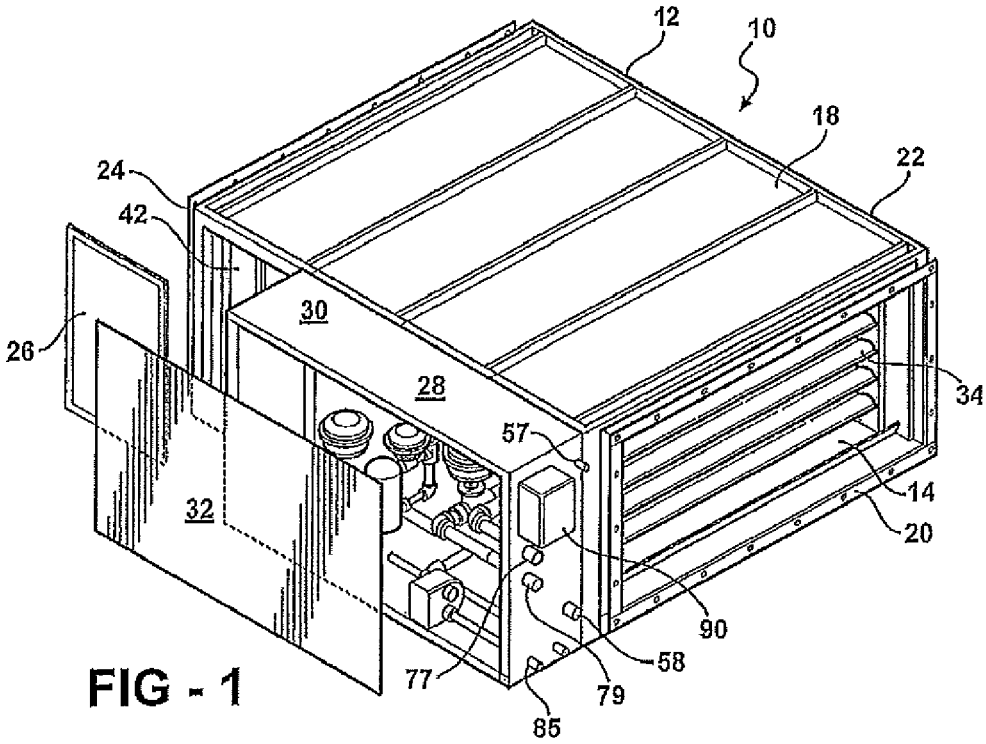
FIG. 1 is a perspective view of the invention depicting the major components thereof.
Figure 1A:
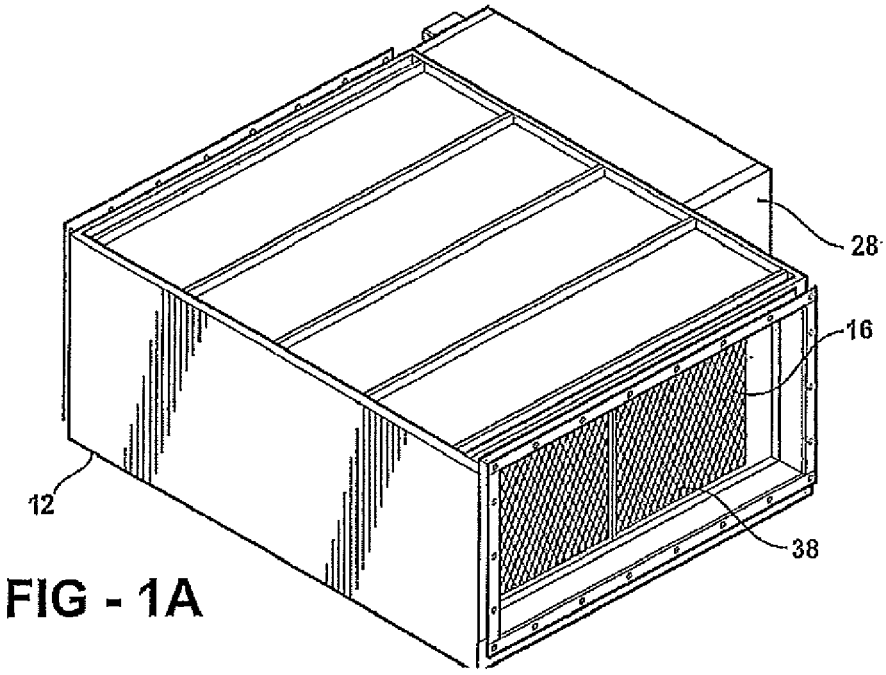
FIG. 1A is a perspective view of the invention as depicted in FIG. 1, viewed from the opposite side.
Figure 6:
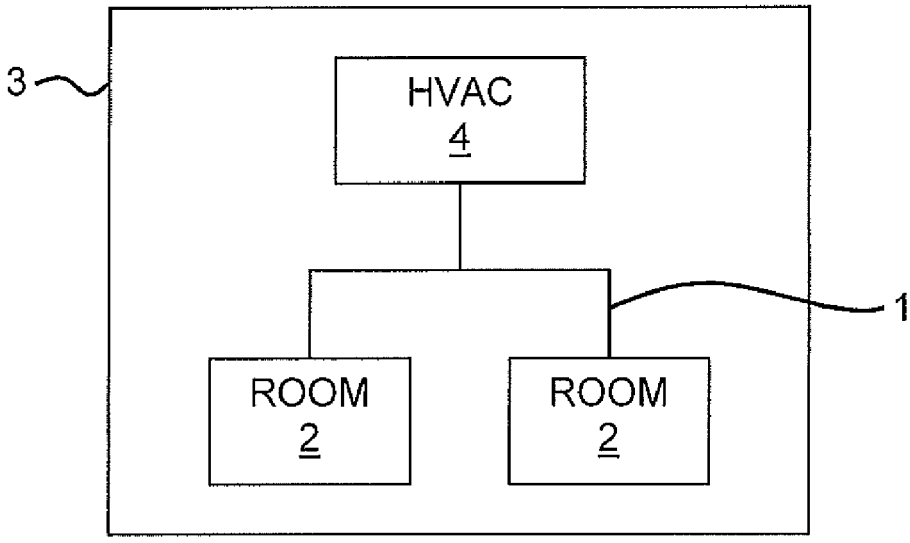
FIG. 6 is an illustration showing a building structure.

Referring first to FIGS. 1, 1A, and 6, the overall structure of the invention and its major components will be best understood. The invention is in the form of a self-contained module 10 comprising an enclosure 12 surrounding a plenum having an inlet 14 and an outlet 16. Air to be conditioned passes into inlet 14, through the plenum of the enclosure 12 and to outlet 16. In the preferred embodiment, the module 10 is designed with a configuration and dimension to fit completely within existing duct work 1 serving a room 2 or compartment within a larger building structure 3. In one embodiment, a typical application is a hospital operating room 2 with the module 10 being placed within the air supply duct work 1 supplying air to the hospital operating room 2. Similarly, module 10 may be part of a recirculating air handling system for a compartment or room 2, in which only an individual compartment or room 2 is being serviced by the module 10 and any associated heating, ventilating and air conditioning equipment 4 and duct work 1.

In the embodiment described, enclosure 12 is in the form of a six-sided box having a top 18, a bottom 20, a first side 22, a second side 24, an inlet 14 and an outlet 16. Co-located with and optionally affixed to first side 24 of enclosure 12 is a control cabinet 28 which carries various controls, plumbing and valves for operation of the module 10 as will be described in greater detail herein. Control cabinet 28 consists of a four-sided cabinet surround 30 and a cabinet cover 32 removably attachable to cabinet surround 30. At the inlet 14 of the enclosure 12 is a damper assembly 36 provided with a plurality of mechanically operable louvers 34. At the outlet 16 of enclosure 12 is a grate 38 through which air may freely pass. At one end of the plenum 40 one or more filters 42 are positioned to filter dust and other particulate matter from the air passing through the plenum 40 and outlet 16. In this embodiment, said one or more filters 42 are removably positioned near the outlet 16 of enclosure 12, with access to filters 42 being afforded by a removable filter access panel 26.

To provide the necessary heating, cooling and humidifying media to the invention, a hot water inlet 57 is provided, which communicates with a hot water outlet 58. Likewise, chilled water inlet 77 communicates with a chilled water outlet 79, and a steam inlet 92 communicates with a steam conduit return 85. Electrical connections to the control valves contained within the control cabinet 28 are routed through electrical junction box 90.

Figure 2:
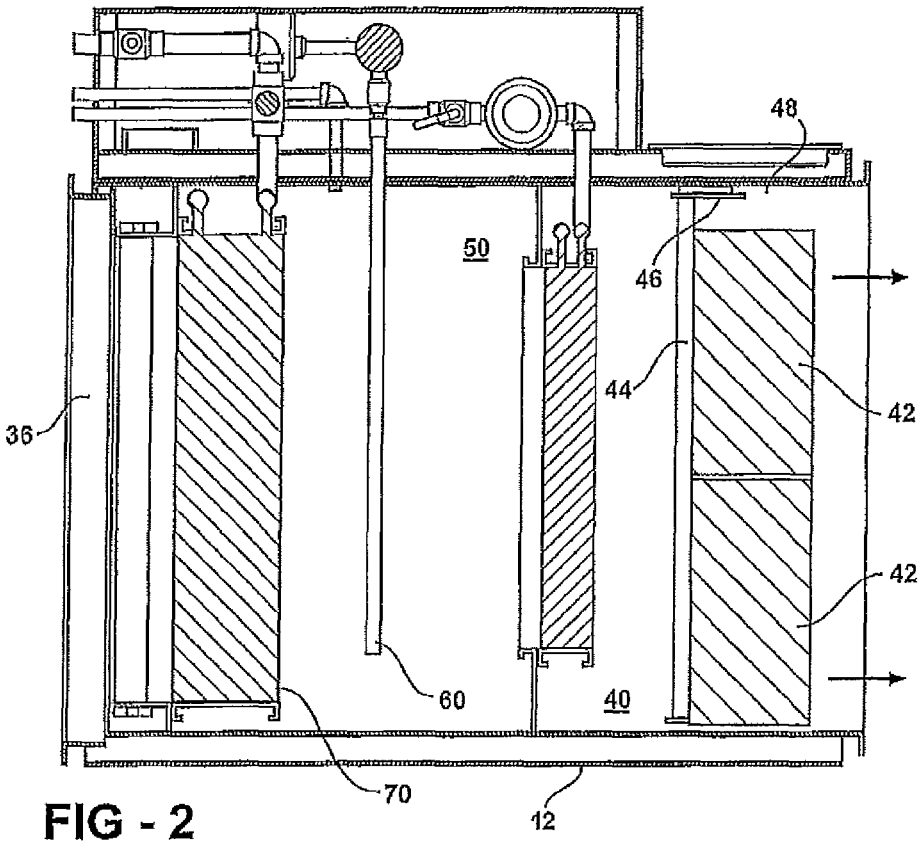
FIG. 2 is a top cutaway view showing the internal components of the invention.
Figure 3:
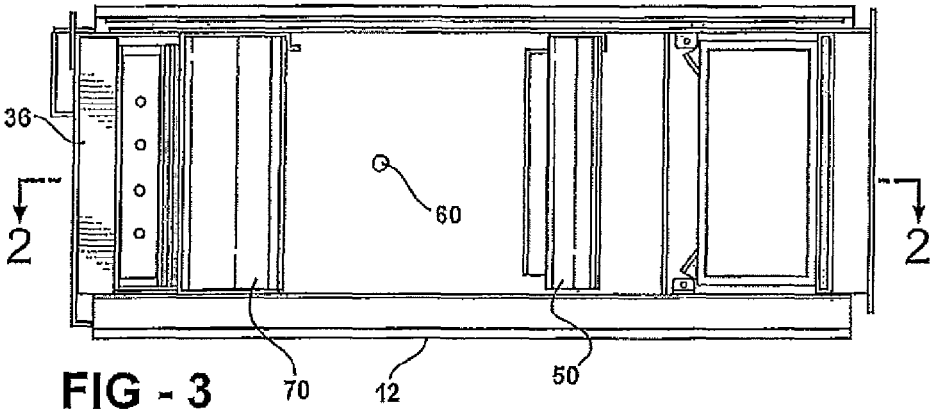
FIG. 3 is a side cutaway view of the invention.

Detailed operation of the invention will be appreciated by reference next to FIG. 2. Located at the inlet side of enclosure 12 is a damper 36 incorporating a plurality of louvers 34 which may be selectively positioned to regulate the amount of air entering the plenum 40. Downstream from damper 36 is a cooling coil 70 which may be in the form of a radiator coil having a relatively large surface area over which air entering the plenum may pass. Further downstream is a humidifier assembly 60, which may be in the form of a perforated tube into which high pressure steam is injected and sprayed into the plenum 40. Further downstream is a heating coil 50 which may be in the form of a radiator through which hot water passes. At the discharge end of the plenum 40, one or more filters 42 through which the air in the plenum passes as it exits from the outlet 16 of the enclosure 12. The position of these components is also depicted in side view of FIG. 3.

Figure 4:
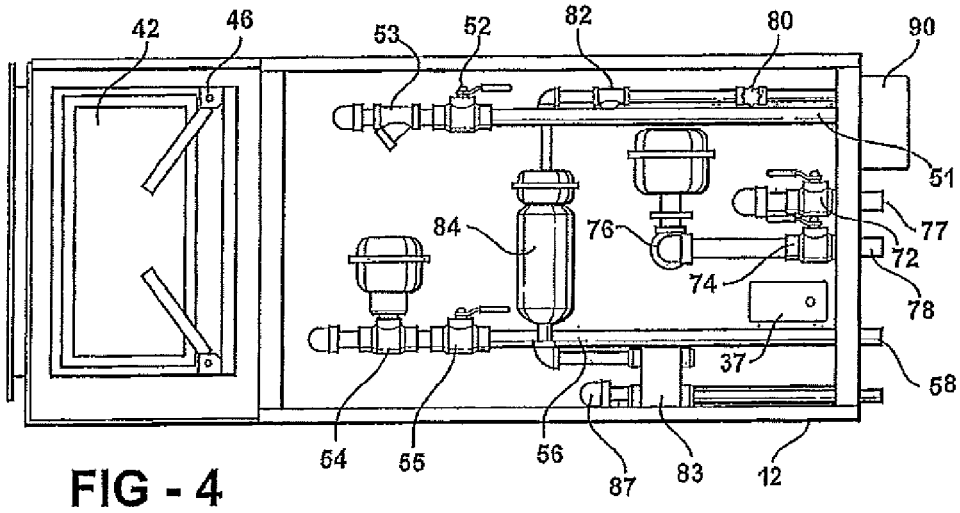
FIG. 4 is a side view of the invention with the control cabinet and filter access covers removed.

With reference now to FIG. 4, the detailed operation of the heating; cooling and humidifying media will be better appreciated. The damper 36 is controlled by a damper actuator 37, which is typically an electromechanical device which regulates the position of the damper louvers in relation to an electrical input signal. In this fashion, the array of louvers 34 comprising the damper 36 may be selectively angled to regulate the dimensions of the inter-louver spaces, thereby regulating the volume of air passing through the enclosure 12.

Cooling of air passing through the enclosure 12 is accomplished by regulation of the flow of chilled water entering the chilled water inlet 77. The chilled water conduit 78 is provided with both upper chilled water shutoff valve 72 and lower chilled water shutoff valve 74 which are provided to facilitate installation and service of the invention, but which, during normal operation of the invention, are normally maintained in the open positions. Accordingly, chilled water enters through the chilled water inlet 77, and then flows to the cooling coil 70. The discharge of the chilled water, and hence the volume of flow of chilled water through the cooling coil 70, is regulated by chilled water control valve 76, which, in turn, is electronically operated by signals from a thermostatic switch (not shown) external to the invention. The chilled water control valve 76 is continuously variable, and by regulating the flow of chilled water through the cooling coil 70, thereby regulates the temperature of the cooling coil 70 in relation to the flow of air through the plenum 40. Chilled water is discharged from the cooling coil through the chilled water outlet 79.

The humidity of the air passing through plenum 40 is regulated by regulating the flow of steam to the humidifier assembly 60. Steam enters steam supply conduit 81, and passes through a steam shutoff valve 80 to a steam strainer 82. Shutoff valve 80 is provided to facilitate installation and service of the invention, and is normally maintained, during operation of the invention, in the open position. Steam strainer 82 is designed to strain particulate matter from the steam stream prior to its entry to steam control/separator 84. Control valve/separator 84 serves to regulate the volume of steam entering the humidifier assembly 60, and to separate out condensed water. A portion of the steam entering the steam valve/separator is routed to the humidifier assembly 60 where it is injected into the air within plenum 40, and remaining steam and condensate is discharged from the bottom of the steam control valve/separator 84, and thence to the steam condensate trap 83. Liquid water condensing within the plenum 40 collects on the inside of the bottom 20 of the enclosure 12 where it is collected by a drain 87 which also communicates with the steam condensate trap 83. Water so collected from the steam control valve/separator 84 and drain 87 is fed through steam condensate trap 83 to steam condensate return line 85, where it is cycled to the steam generating facility within the structure being served.

Air within the plenum 40 may be heated by heating coil 50. As with the chilled water and steam control valves, the hot water control valve 54 is electronically controlled by an external thermostat or humidistat, or some combination thereof. Hot water enters the system through inlet 57 and conduit 51, where its entry to the heating coil 50 is regulated first by hot water shutoff valve 52. Hot water shutoff valve 52 is provided to facilitate installation and service of the invention, and is normally maintained, during operation, in the open position. Hot water then passes through a hot water strainer 53 which filters out particulate matter prior to the hot water entering the heating coil 50. Hot water passes through heating coil 50 to hot water control valve 54, which regulates the volume of hot water permitted to flow through the heating coil 50. Lower hot water shutoff valve 55 is provided, in a similar fashion, to upper hot water shutoff valve 52. Water passing through the hot water circuit is discharged at hot water outlet 58.

Signals for the chilled water control valve 76, steam control valve/separator 84 and hot water control valve 54 are preferably provided by one or more thermostats and/or humidistats, which send signals, through the electrical junction box 90 to the various control valves to increase or decrease the flow of cold water, steam, and hot water, respectively, depending on commands from the thermostats and humidistats.

Air within the plenum 40 then exits the plenum by passing through air filters 42, which are retained in fixed position within the enclosure 12 by filter sealing arms 46.

Figure 5:
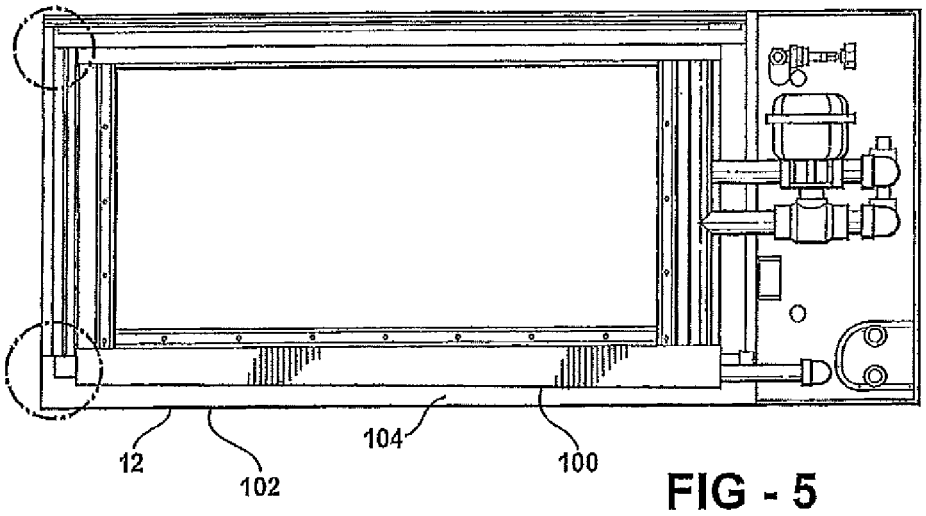
FIG. 5 is an end view of the outlet end of the invention.
Figure 5A:
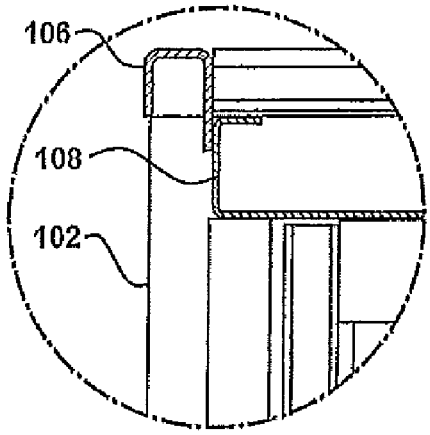
FIG. 5A is a detailed view of one corner of the wall structure of the invention.
Figure 5B:
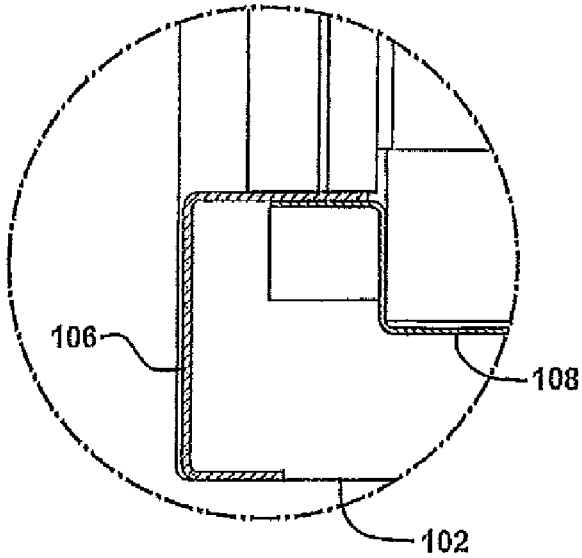
FIG. 5B is a detailed view of another corner of the invention.

To thermally isolate the plenum 40 from the surrounding environment into which the module 10 is placed, a double sided wall structure is incorporated as shown in FIG. 5A, which depicts a cross-section of an upper wall of the module 10 and FIG. 5B, which depicts, in cross-section, a lower corner of the structure. The side walls, bottom and top of the enclosure are preferably of double-walled construction, having an inner wall 108 and an outer wall 102. Since the walls are of conventional metal construction, it is desirable that the interior of the module, plenum 40, be thermally isolated from the ductwork into which the module 10 is placed. It is also preferable that installation surround the plenum to minimize energy transmission to the surrounding structure. This effect is achieved by the interposition of isolating elements 106, which are preferably formed of thermoplastic having robust insulating qualities. By positioning isolators 106 as depicted in FIGS. 5A and 5B, the metal walls surrounding plenum 40 are thermally isolated from the outer wall 102 of the module 10. The structure also features the inner wall 108 and between inner wall 108 and outer wall 102 is placed insulating material 104, such as fiberglass batting, or injected urethane foam, thereby providing additional insulation between the outer wall 102 of the module 10 and the plenum 40. In this fashion, plenum 40 is thermally isolated from the surrounding environment.

In another embodiment of the invention, the module 10 is provided with one or more mounting flanges configured to secure the air inlet of the enclosure 12 to existing duct work in a HVAC system.

We claim:

1. An air conditioning module for use with a duct of a central HVAC system of a structure, the module comprising:

an enclosure that defines a substantially enclosed plenum, the enclosure having an inlet that is in communication with the plenum for receiving a supply of air from the duct of the central HVAC system and an outlet that is in communication with the plenum for exhausting the air the enclosure having an inner wall that is adjacent to the plenum and an outer wall that is adjacent to the inner wall, wherein both the inner wall and the outer wall cooperate to define the inlet and the outlet of the enclosure;

at least one air conditioning component disposed within the plenum for conditioning the air;

the enclosure being configured to be positionable entirely within the duct of the central HVAC system such that that the outer wall of the enclosure is in thermal communication with the duct; and a thermal isolator structure that connects the inner wall of the enclosure to the outer wall of the enclosure to prevent conduction of heat between the inner wall of the enclosure and the outer wall of the enclosure such that heat is not directly transferred between the inner wall of the enclosure and the duct.

2. The air conditioning module of claim 1, wherein the air conditioning is controllable independent of the central HVAC system.

3. The air conditioning module of claim 1, wherein the outlet of the enclosure is configured to return the air to the duct.

4. The air conditioning module of claim 1, further comprising:

a filter disposed within the enclosure adjacent to the outlet, such that the air passes through the filter as it exits the enclosure.

5. The air conditioning module of claim 1, further comprising:

a plurality of louvers positioned adjacent to the inlet of the enclosure; and an electromechanical actuator that is connected to the louvers for regulating the position of the louvers, such that the amount of air that enters the enclosure from the duct of the central HVAC system may be regulated by the louvers.

6. The air conditioning module of claim 1, wherein there are no devices positioned within the enclosure that draw air into the plenum of the enclosure.

7. The air conditioning module of claim 1, further comprising:

the at least one air conditioning component including at least one of a cooling coil, a humidifier, or a heating coil.

8. The air conditioning module of claim 1, further comprising:

a control assembly for regulating the at least one air conditioning component, the control assembly positioned within the enclosure.

9. A system, comprising:

a structure having a plurality of rooms;

a central HVAC system having a plurality of ducts that supply conditioned air to the plurality of rooms of the structure; and a module for use with a specific duct of the plurality of ducts to provide separate control of the environmental condition within a specific room of the plurality of rooms, the module having:

an enclosure having a top, a bottom a first side and a second side that define a substantially enclosed plenum, the enclosure having an inlet that is in communication with the plenum for receiving the conditioned air from the specific duct of the central HVAC system and an outlet that is in communication with the plenum for exhausting the air, wherein the enclosure is configured to be positionable entirely within the duct of the central HVAC system; and at least one air conditioning component disposed within the plenum for conditioning the air.

10. An air conditioning module for use with a duct of a central HVAC system of a structure, the module comprising:

an enclosure that defines a substantially enclosed plenum, the enclosure having an inlet that is in communication with the plenum for receiving a supply of air from the duct of the central HVAC system and an outlet that is in communication with the plenum for exhausting the air, the enclosure having an inner wall that is adjacent to the plenum and an outer wall that is adjacent to the inner wall, wherein both the inner wall and the outer wall cooperate to define the inlet and the outlet of the enclosure;

at least one air conditioning component disposed within the plenum for conditioning the air;

the enclosure configured to be connected to the duct at the inlet of the enclosure, such that the outer wall of the enclosure is in thermal communication with the duct; and a thermal isolator structure that connects the inner wall of the enclosure to the outer wall of the enclosure to prevent conduction of heat between the inner wall of the enclosure and the outer wall of the enclosure such that heat is not directly transferred between the inner wall of the enclosure and the duct.

11. The air conditioning module of claim 10, wherein the air conditioning is controllable independent of the central HVAC system.

12. The air conditioning module of claim 10, wherein the outlet of the enclosure is configured to return the air to the duct.

13. The air conditioning module of claim 10, further comprising:

a filter disposed within the enclosure adjacent to the outlet, such that the air passes through the filter as it exits the enclosure.

14. The air conditioning module of claim 10, wherein the enclosure is configured to be positionable entirely within the duct of the central HVAC system.

15. The air conditioning module of claim 10, wherein the enclosure is configured to be connected to the duct at the inlet of the enclosure.

16. The air conditioning module of claim 15, wherein the enclosure is configured to be connected to the duct at the outlet of the enclosure.

* * * * *